US007464524B2

(12) United States Patent
Pendry

(10) Patent No.: US 7,464,524 B2
(45) Date of Patent: Dec. 16, 2008

(54) ADJUSTABLE BRIDLE

(76) Inventor: Terence Pendry, North Lodge, The Royal Mews Windsor Castle, Windsor, Berkshire, SL4 1NG (GB)

( * ) Notice: Subject to any disclaimer, the term of this patent is extended or adjusted under 35 U.S.C. 154(b) by 0 days.

(21) Appl. No.: 11/644,808

(22) Filed: Dec. 21, 2006

(65) Prior Publication Data

US 2008/0148693 A1 Jun. 26, 2008

(51) Int. Cl.
*B68B 1/06* (2006.01)

(52) U.S. Cl. ..... 54/8

(58) Field of Classification Search ..... 54/6.1, 54/7–9, 36

See application file for complete search history.

(56) References Cited

U.S. PATENT DOCUMENTS

| | | | | | |
|---|---|---|---|---|---|
| 112,398 | A | * | 3/1871 | Weatherhead | 54/6.1 |
| 230,922 | A | * | 8/1880 | Cole | 54/6.1 |
| 437,867 | A | | 10/1890 | O'Conner | |
| 474,739 | A | * | 5/1892 | Hollingsworth | 54/6.1 |
| 487,565 | A | * | 12/1892 | Hasselbauer | 54/6.1 |
| 805,606 | A | | 1/1905 | Werk | |
| 843,689 | A | | 2/1907 | McClintock | |
| 1,209,724 | A | * | 12/1916 | Koepke | 54/6.1 |
| 1,746,403 | A | | 2/1930 | Mulcahy | |
| 2,804,741 | A | | 9/1957 | Cheesebro | |
| 3,401,500 | A | | 9/1968 | Wright | |
| 3,604,183 | A | | 9/1971 | Jun | |
| 3,906,707 | A | | 9/1975 | Morgan | |
| 3,949,538 | A | | 4/1976 | Woodruff | |
| 4,173,109 | A | | 11/1979 | Hibbert | |
| 4,369,615 | A | | 1/1983 | Bloodworth | |
| 4,472,925 | A | | 9/1984 | Woodruff | |
| 4,495,752 | A | | 1/1985 | Simpson | |
| 4,566,254 | A | | 1/1986 | Nagel | |
| 5,930,985 | A | | 8/1999 | Jacobs | |
| 6,260,338 | B1 | | 7/2001 | Wheeler | |
| 6,425,229 | B2 | | 7/2002 | Sprenger et al. | |
| 6,691,497 | B1 | | 2/2004 | Rodgers | |
| 6,983,581 | B2 | | 1/2006 | Collins | |
| 2005/0034434 | A1 | | 2/2005 | Nishimura | |

* cited by examiner

*Primary Examiner*—Son T. Nguyen
(74) *Attorney, Agent, or Firm*—Michael Zarrabian, Esq.; Myers Dawes Andras & Sherman, LLP

(57) ABSTRACT

The present invention provides a bridle for an animal, such as a horse, wherein the bridle can be adjusted, and readjusted, simply, and without altering buckles, clasps, and/or fasteners. Such an adjustable bridle for mounting on the head of an animal includes a mouthpiece including an elongate bit having a first end and a second end, a first strap, a second strap and a pulley ring, wherein the first strap is shorter in length than the second strap, wherein the first strap has a first end and a second end, such that the first end of the first strap is attached to the first end of the bit, and the second end of the first strap is attached to the pulley ring. The second strap has a first end and a second end, corresponding to the first end and the second end of the bit, respectively, such that the first end of the second strap is attached to the first end of the bit along with said first end of the first strap, and the second end of the second strap is attached to the second end of the bit, such that the second strap passes through the pulley ring.

8 Claims, 5 Drawing Sheets

ADJUSTABLE BRIDLE

FIELD OF THE INVENTION

The present invention relates to bridles and in particular, to adjustable bridles.

BACKGROUND OF THE INVENTION

A bridle is a device that is utilized to control an animal, such as a horse. A typical bridle fits over the head of the animal, and holds a bit in the mouth of the animal. Such a bridle includes a crownpiece that fits over the head of the animal, resting behind the animal's ears, forming a main strap that holds the bridle in place and prevents the bit from slipping down. The bridle also includes two cheekpieces attached to either side of the crownpiece. The cheekpieces drop down along the cheeks of the animal, and attach to rings that hold the bit. The crownpiece further includes a throatlatch that prevents the bridle from coming off over the head of the animal. The throatlatch extends from the crownpiece down from one ear of the animal, under the windpipe, and attaches below the other ear. The bridle further includes a browband, wherein the crownpiece passes through the browband. The browband extends from under one ear of the animal, across the forehead, to under the other ear. A noseband goes around the nose of the animal. The bridle further includes reins attached to the bit below the cheekpieces, allowing a rider to control the horse. The pieces of the bridle are held together by buckles, clasps, and/or fasteners that allow adjustments to the bridle.

For example, the width of the bit is adjusted to the width of the mouth of the animal. The length of the cheekpieces is adjusted so that the bit is held at the proper location in the mouth of the animal. The noseband is adjusted to leave some comfort space between the noseband and the nose of the animal. The browband is adjusted so as to not pull the bridle forward, and to prevent discomfort to the ears of the animal.

Proper fitting of a conventional bridle requires that the length of each piece of the bridle be adjusted to fit the head of the animal. This is done by altering all the necessary buckles, clasps, and/or fasteners to provide the proper fit, depending on the animal's physical characteristics. Altering the buckles, clasps, and/or fasteners involves opening, closing, loosening, and/or tightening each one, to adjusting the length of a piece of the bridle attached thereto.

As such, proper fitting of a conventional bridle involves the laborious task of manipulating each buckle, clasp, and/or fastener to adjust the length of each piece of the bridle for a particular animal. Then, when removing the bridle, the buckles, clasps, and/or fasteners must be manipulated to loosen the bridle, and remove it from the animal. Then, in order to attach the bridle to another animal, the same laborious and time consuming fitting steps by altering the buckles, clasps, and/or fasteners, must be repeated. Often, riders carry a separate bridle for each animal, wherein each bridle has been adjusted for a particular animal. Such bridles are also complex to manufacture and maintain due to the various pieces and the buckles, clasps, and/or fasteners. There is, therefore, a need for a bridle that can be adjusted, and readjusted, simply, and without altering buckles, clasps, and/or fasteners.

BRIEF SUMMARY OF THE INVENTION

The present invention provides a bridle for an animal, such as a horse, wherein the bridle can be adjusted, and readjusted, simply, and without altering buckles, clasps, and/or fasteners.

This allows a rider the opportunity to easily use the bridle on many animals of different head sizes. This also eliminates the need to carry a separate bridle for each animal.

In one embodiment, the bridle comprises a mouthpiece including an elongate bit having a first end and a second end, a short rope (strap), a long rope and a pulley ring, wherein the short rope has a first end and a second end, such that the first end of the short rope is attached to the first end of the bit, and the second end of the short rope is attached to the pulley ring. Further, the long rope has a first end and a second end, corresponding to the first end and the second end of the bit, respectively, such that the first end of the long rope is attached to the first end of the bit along with said first end of the short rope, and the second end of the long rope is attached to a bit ring at the second end of the bit, such that the long rope passes through the bit ring and the pulley ring. The long rope forms reins for riding the animal. The second of the long rope is detachable from the bit ring at the second end of the bit such that the long rope can be detached from the second end of the bit to lead the animal from the second end of the long rope.

The bridle is adjustable for a smaller animal head by pulling the long rope through the pulley ring to shorten a portion of the long rope running between the pulley ring and the second end of the bit. The bridle is adjustable for a larger animal head by slackening the long rope through the pulley ring to lengthen a portion of the long rope running between the pulley ring and the second end of the bit.

These and other features, aspects and advantages of the present invention will become understood with reference to the following description, appended claims and accompanying figures.

DETAILED DESCRIPTION OF THE INVENTION

The present invention provides a bridle for an animal, such as a horse, wherein the bridle can be adjusted, and readjusted, simply, and without altering buckles, clasps, and/or fasteners. This allows a rider to the opportunity to easily use the bridle on many animals. This also eliminates the need to carry a separate bridle for each animal.

Figure 2:
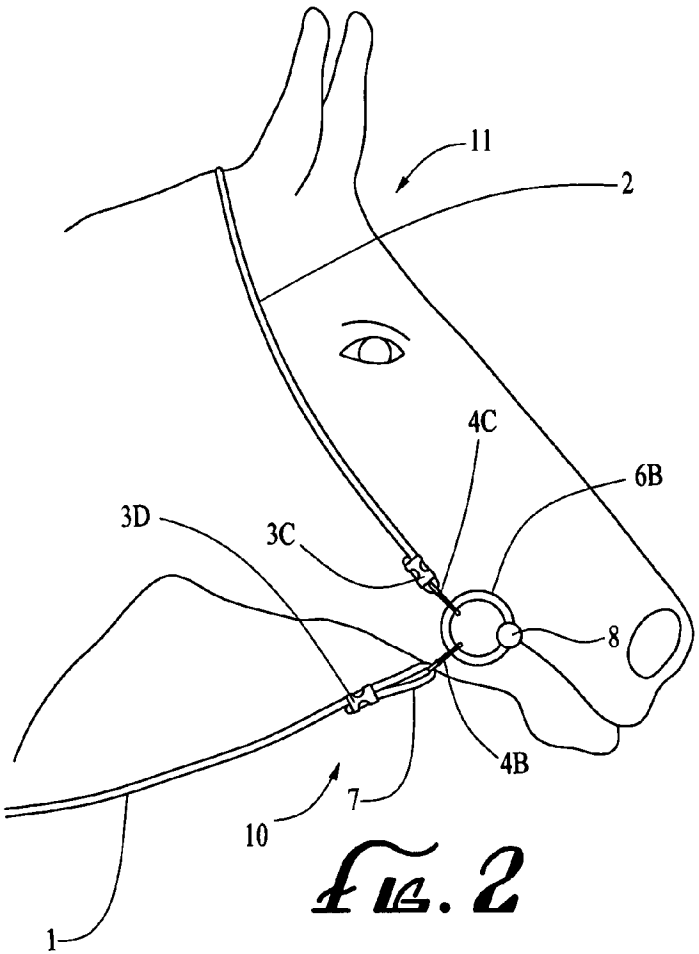
FIG. 2 shows a right side view of the bridle of FIG. 1, according to an embodiment of the present invention, which is fitted to a horse.
Figure 1:
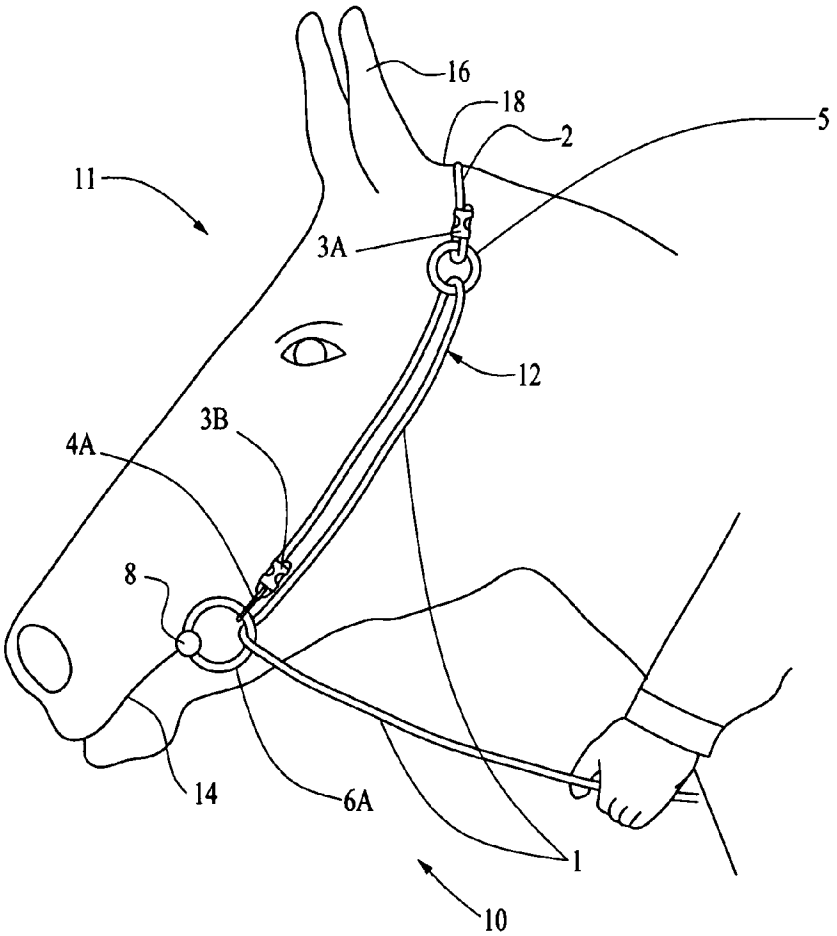
FIG. 1 shows a left side view of a bridle, according to an embodiment of the present invention, which is fitted to a horse.
Figure 5:
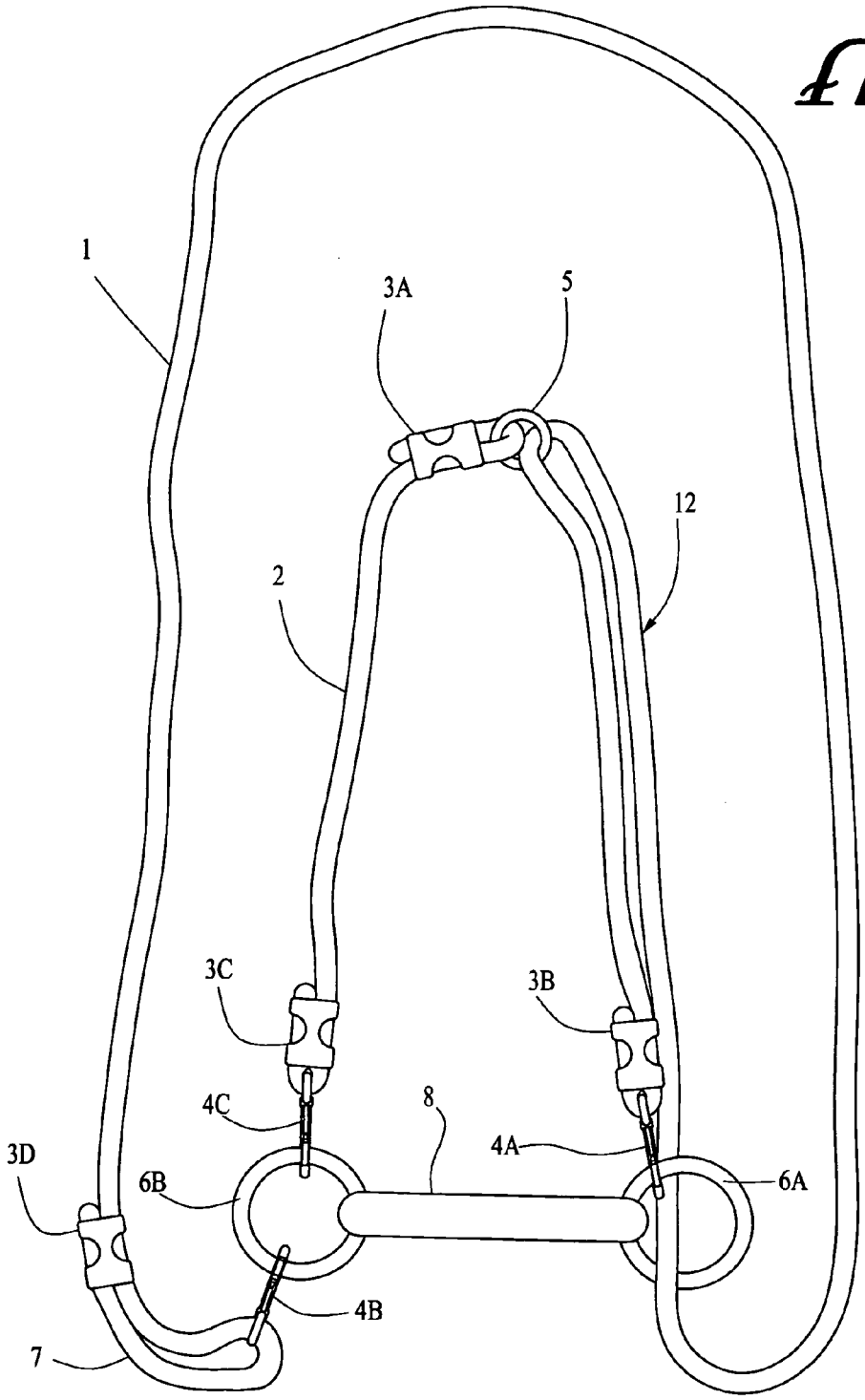
FIG. 5 shows a plan view of a bridle, according to an embodiment of the present invention.

FIG. 1 shows a left side view of a bridle 10 according to an embodiment of the present invention, wherein a horse 11 is wearing the bridle on its head. FIG. 2 shows a right side view of the bridle 10 on the head of the horse 11. Referring now also to FIG. 5, which shows a plan view of the bridle 10 laid out flat, the bridle 10 comprises: a long rope 1; a short rope 2; four clamps 3A, 3B, 3C, 3D; three swivel clips 4A, 4B, 4C; a pulley ring 5; two snaffle bit rings 6A, 6B; a rope handle 7; and a rubber loose ring snaffle bit 8.

Figure 6:
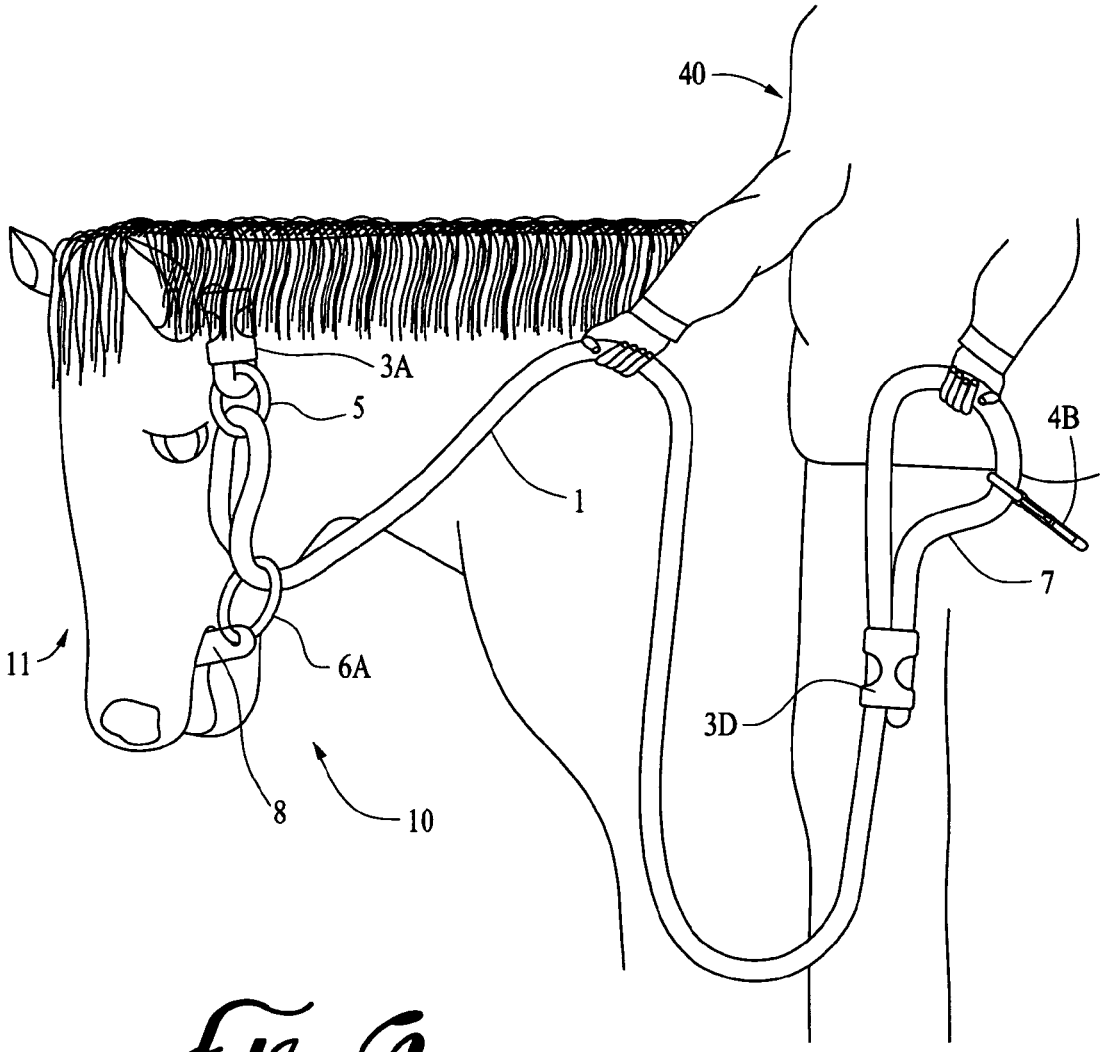
FIG. 6 shows a perspective view of a rider using a lead rope, according to an embodiment of the present invention.

The long rope 1, acts as both riding reins (FIGS. 1-2) and as a leading rein (FIG. 6). Each of the four clamps 3A-D is located at each end of the long rope 1 and the short rope 2. Each of the four clamps creates a loop in an end of the corresponding rope, which enables attachment of the long rope 1 between the swivel clips 4A and 4B, and the attachment of the short rope 2 between the ring 5 and the swivel clip 4C. The swivel clip 4A, located at an end of the long rope 1, is clipped to the ring 6A and can be unclipped therefrom. The swivel clip 4B, located at another end of the long rope 1, is clipped to the ring 6B and can be unclipped therefrom. The swivel clip 4C, located at an end of the long rope 2, is also clipped to the ring 6B, and can be unclipped therefrom. The rings 6A and 6B are connected to each end of the bit 8. In one example, the rings 6A-B freely pass through holes at each end of the bit 8.

At a first end of the long rope 1 is the rope handle 7, which is formed using the clamp 3D (FIG. 5). The clamp 3D is used to attach the first end of the long rope 1 to a location along the length of the long rope 1 to form the rope handle 7 as a loop. The second end of the long rope 1 passes first through the ring 6A and then through the ring 5, and then the clamp 3B is used to attach the second end of the long rope 1 to a location along the length of the long rope 1, forming a loop to which a first end of the elongated swivel clip 4A is attached. The rings 5 and 6A are wide enough to allow free movement of the long rope 1 therethrough. In the example shown, the ring 5 is smaller in diameter than the ring 6A. At its other end, the swivel clip 4A is attached to the ring 6A, wherein the ring 6A passes through an opening in the swivel clip 4A. The swivel clip 4A can freely slide on the ring 6A.

The short rope 2 forms the head piece of the bridle 10. At a first end of the short rope 2, the clamp 3C is used to attach the first end of the short rope 2 to a location along the length of the short rope 2, forming a loop to which a first end of the elongated swivel clip 4C is attached. At its other end, the swivel clip 4C is attached to the ring 6B, wherein the ring 6B passes through an opening in the swivel clip 4C. The swivel clip 4C can freely slide on the ring 6B. At a second end of the short rope 2, the clamp 3A is used to attach the second end of the short rope 2 to a location along the length of the short rope 2, forming a loop through which the ring 5 passes, thereby attaching the second end of the short rope 2 to the ring 5. The ring 5 acts as a rope adjustment pulley, allowing the long rope 1 to be adjusted to any length, to appropriately fit animals with different head shapes and sizes.

Referring to FIGS. 1-2 and 5, to fit the bridle 10 on the horse 11, the rider anticipates the length of the bridle needed. The bit 8 is offered into the horse's mouth 14, and the short rope 2 is pulled over the horse's ears 16 to fit neatly on the top of the pole 18 (FIG. 1) of the horse. FIG. 2 shows the short rope 2 going up and over the horse's head while the long rope 1 attached to the bit 8 via the rings 6A, 6B, acts as reins. FIG. 1 shows the adjustment of the long rope 1 through the ring 5 for a large horse. FIG. 2 shows the short rope 2 going up the right cheek and over the horse's head, while the long rope 1, attached to the rings 6A-B, functions as reins.

Figure 4:
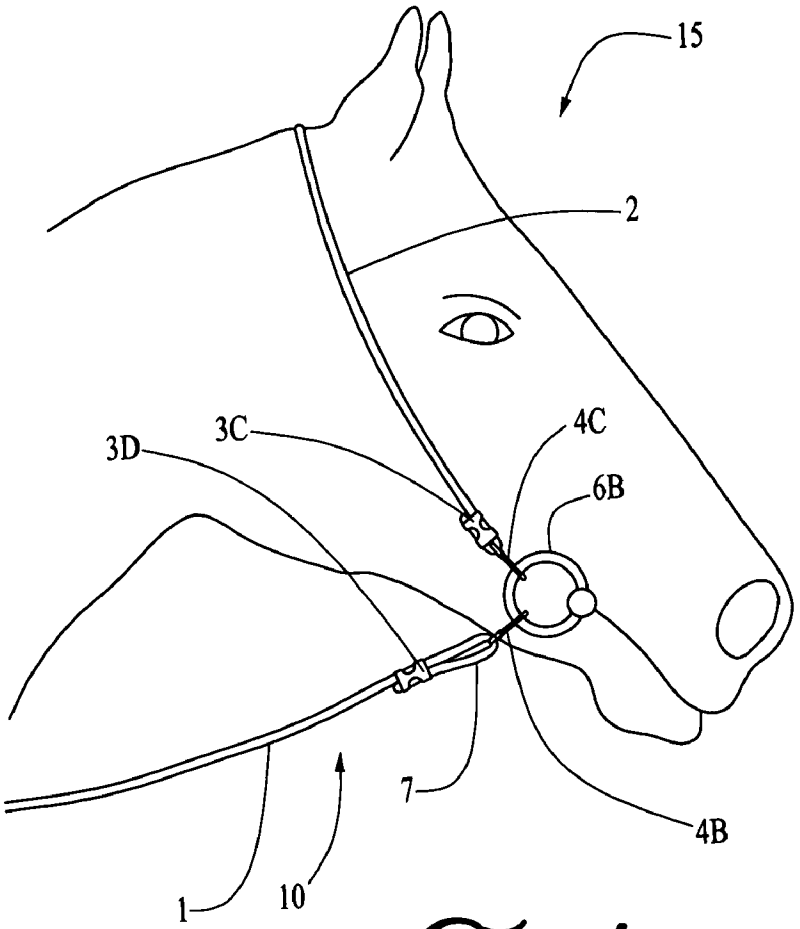
FIG. 4 shows a right side view of the bridle of FIG. 3.
Figure 3:
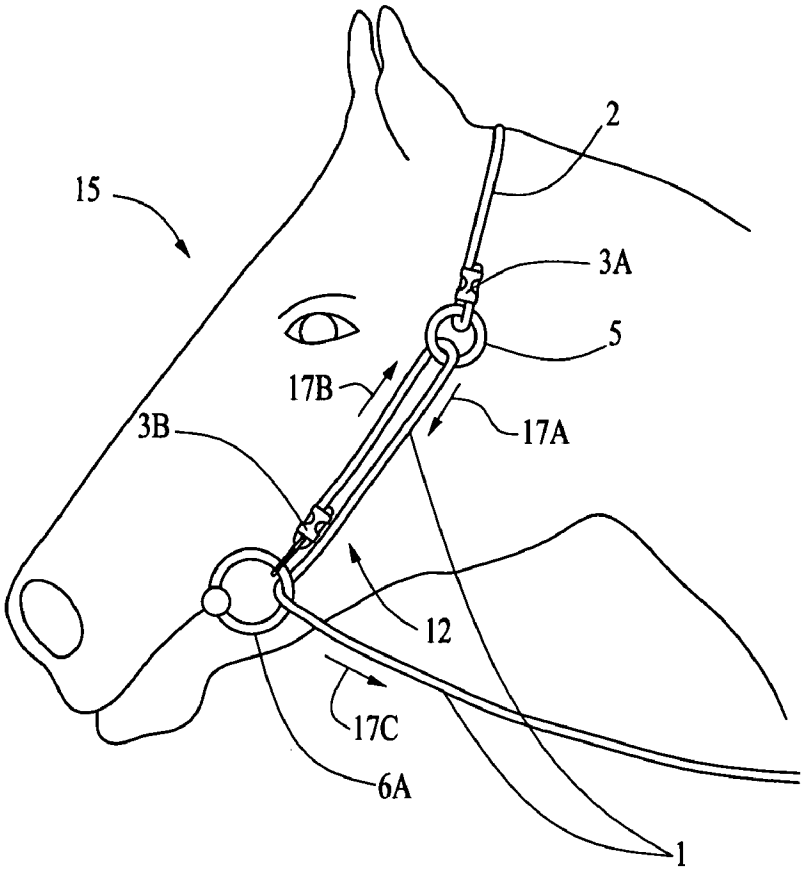
FIG. 3 shows a left side view of the bridle of FIG. 1, adjusted to fit a horse smaller than the horse in FIG. 1.

FIGS. 3-4 show the bridle 10 adjusted to fit a horse 15 with a smaller head than the horse 11 in FIG. 1. FIG. 3 shows the left side of the head of the smaller horse 15, illustrating the difference in position of the short rope 2 attached to the ring 5 and the resulting shorter adjustment (relative to FIG. 1) in the length of the running part 12 of the long rope 1 of the bridle 10 along the left cheek of the horse. FIG. 4 shows the right side of the head of the horse 15, illustrating the short rope 2 going up the right cheek and over the head of the horse 15, while the long rope 1 attached to the rings 6A-B functions as reins for riding the horse 15.

In FIG. 3, the ring 5 is closer to the ring 6A along the left cheek of the smaller horse 15 than for the larger horse 11 in FIG. 1. The rider adjusts the bridle 10 by manipulating a running part 12 of the long rope 1 on the left cheek of the head of the horse, between the ring 5 and the bit ring 6A. The rider adjusts the bridle 10 by pulling (for a smaller head) or slackening (for a larger head) the running part 12 of the long rope 1, to fit the horse's head comfortably. For a smaller horse, the rider pulls down on the running part 12 of the long rope 1 along direction 17A. The ring 5 acts as a pulley, allowing the portion of the long rope 1 between the clamp 3B and the ring 5 to be pulled up along direction 17B. This causes the ring 5 to move down the cheek of the horse closer to the ring 6A.

As the running portion 12 is pulled down, the ring 5 moves closer to the ring 6A along direction 17A, thereby shortening the length of the running part 12 of the rope between the rings 5 and 6A. Effectively, in FIG. 3 for the smaller horse 15, there is less of the long rope 1 stretched between the rings 5 and 6A, than that in FIG. 1 for the larger horse 11. As such, the only adjustment for fit is made by pulling or slackening the running part 12 of the long rope 1 through the ring 5 which acts as a pulley. Final adjustment is made by gently pulling down on the long rope 1. Relative to FIG. 1, the long rope 1 is pulled to pass through (feed out of) the ring 6A along the direction marked by the arrow 17C.

To make the bridle 10 fit the larger horse 11, the opposite steps are followed, wherein the running part 12 is slackened, causing the long rope to travel in a direction opposite to the arrows 17A-C, moving the ring 5 away from the ring 6A, lengthening the running part 12, to fit the bridle over the head of a larger horse 11 (FIG. 1).

The bridle 10 operates by a soft gag effect (i.e., a mild tightening effect) and once fitted to the horse or pony, the rider may ride or lead from it. Referring to FIG. 6, to lead from the long rope 1, a rider 40 unclips the swivel clip 4B (FIGS. 2, 4-6) at an end of the long rope 1, from the ring 6B, to free that end of the long rope 1 from the ring 6B, thereby turning the "reins" for riding the horse 11 (FIG. 1) into a "lead rope" (FIG. 6) for leading the horse 11. The rope handle 7 provides a simple handle for leading the horse 11.

Figure 7:
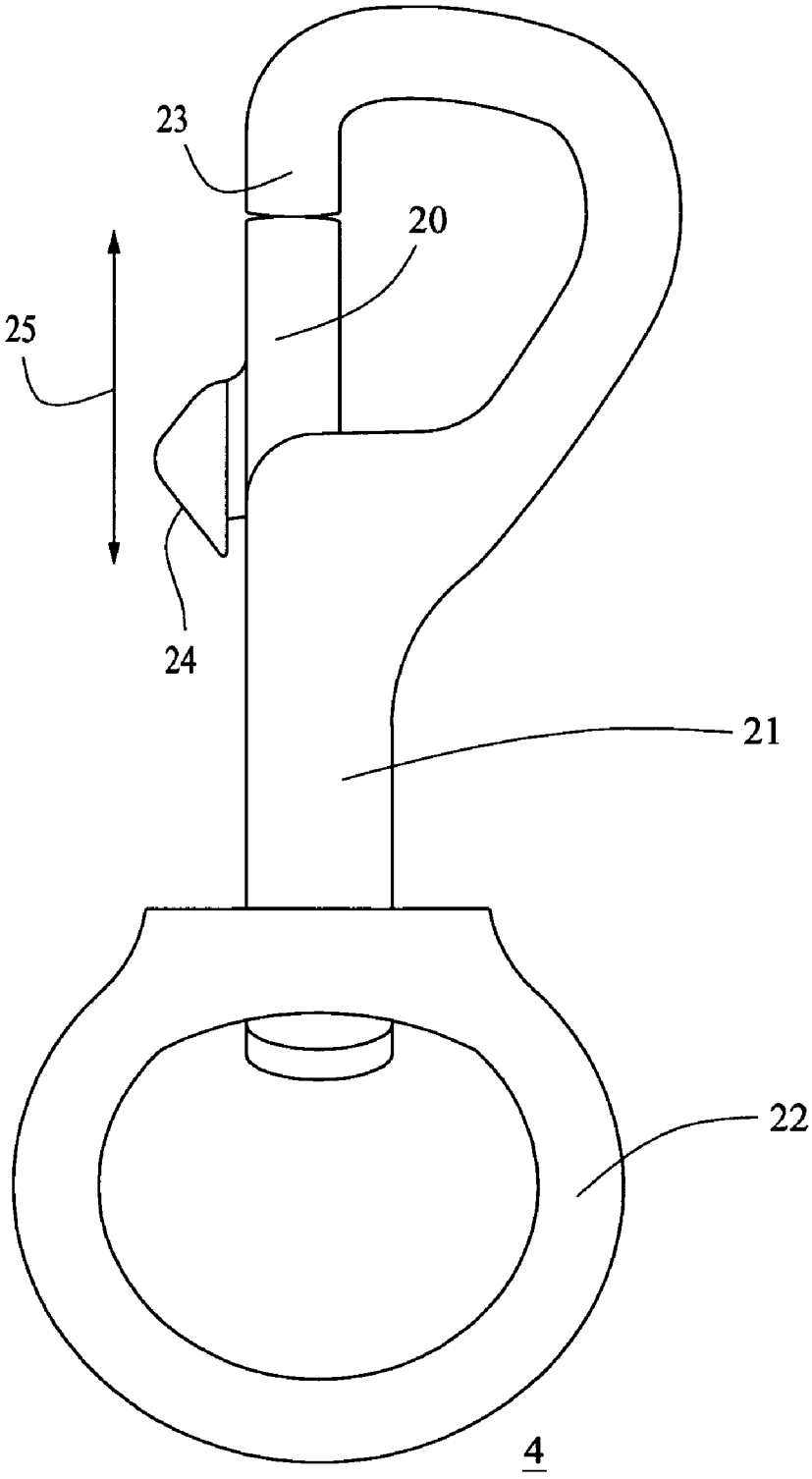
FIG. 7 shows an example swivel clip for the bridle shown in FIG. 5, according to an embodiment of the present invention.

FIG. 7 shows an example swivel clip 4 that can be used as the swivel clips 4A-C. The swivel clip 4 includes a closed loop 22 connected by an elongate member 21 to an eyeloop that is formed by an open hook 23 and a sliding member 20. Sliding the sliding member 20 along direction 25 opens and closes the open hook 23. Sliding the sliding member 20 down towards the closed loop 22 using a tab 24, opens the eyeloop to allow hooking the open hook 23 to the rings 6A or 6B. Sliding the sliding member 20 away from the closed loop 22, closes the open hook 23, to maintain the rings 6A or 6B inside the eyeloop. Then, sliding the sliding member 20 down toward the closed loop 22 again using the tab 24, opens the eyeloop to allow unhooking the open hook 23 from the rings 6A or 6B. The sliding member 20 can be springloaded such that sliding the sliding member 20 down towards the closed loop 22 using the tab 24 loads a spring (e.g., at the base of the sliding member), and releasing the tab 24 allows the spring to unload and slide the sliding member 20 away from the closed loop 22. The closed loop 22 allows passage of the ropes 1 or 2 therethrough. Preferably, the elongate member can be axially rotatable relative to the closed loop 22.

Approximate measurements for an example of the bridle 10 include: the long rope 1 measures about 12'8" (12 feet and 8 inches) in total length, the short rope 2 measures about 2'4"

in total length, each of the clamps 3A-D measures 1¾" in length, each of the swivel clips 4A-C measures 3" in length, the ring 5 measures 1¾" in diameter, each of the rings 6A-B measures 3" in diameter, and the rope handle 7 is about 7" in length. The bit 8 functions as a mouthpiece and comprises a soft pliable elongate rubber about 6" long, with the stainless steel loose rings 6A-B attached to either end. Other materials for the long and short ropes 1, 2 can be used. The clamps 3A-D can be made from brass or other rigid materials. The thickness of the ropes 1, 2 is selected to allow passage through the rings 6A and/or 6B, the ring 5, the closed loop 22 of the swivel clips 4A-C. The swivel clips 4A-C can be made from brass or other rigid materials. The rings 5, 6A-B can be made from brass, steel or other rigid materials. Although the term rope has been used for the examples described herein, each of the ropes 1, 2 is a form of a strap, which can be made from materials such as natural and/or synthetic fabrics, leather, etc. As those skilled in the art will recognize, other dimensions and materials can also be used. Further, the bridle 10 can be made in a mirror image of FIG. 5, wherein, for example, the running part 12 rests on the cheek on the right side of the horse. Further, other means of attachment can be used instead of the clamps 3A-D. Instead of the swivel clips 4A-B, other means of detachably attaching the ends of the long rope 1 to the rings 6A-B can be used. Instead of the swivel clip 4C other means of detachably attaching an end of the short rope to the ring 6B can be used.

Unlike conventional bridles which normally come in three sizes "full", "cob" and "pony", the bridle 10 can be adjusted without having to alter any buckles, clasps or fasteners, making the bridle 10 user friendly and simple to operate. A rider can utilize the same bridle 10 on many different size animals (such as Shire horses, Shetland ponies, etc.). This eliminates the need to carry a separate bridle for each animal. In one example, the bridle 10 can be made small enough to fit into the glove compartment of a car, horse trailer, saddle bag, etc. The selection of the bit 8 and the functioning of the bridle 10 reduce the possibility of damage or harm to the mouth of the animal. The bit 8 can be interchanged with another, by detachment from the rings 6A-B, and reattachment of another bit in its place.

The present invention has been described in considerable detail with reference to certain preferred versions thereof; however, other versions are possible. Therefore, the spirit and scope of the appended claims should not be limited to the description of the preferred versions contained herein.

What is claimed is:

1. An adjustable bridle for mounting on the head of an animal, comprising:

a mouthpiece including an elongate bit having a first end and a second end;

a first strap, a second strap and a pulley ring, wherein the first strap is shorter in length than the second strap;

wherein the first strap has a first end and a second end, such that the first end of the first strap is attached to the first end of the bit, and the second end of the first strap is attached to the pulley ring;

wherein the second strap has a first end and a second end, corresponding to the first end and the second end of the bit, respectively, such that: (i) the first end of the second strap is attached to the first end of the bit along with said first end of the first strap, and (ii) the second end of the second strap is attached to the second end of the bit, such that the second strap passes through the pulley ring;

wherein the mouthpiece further includes a first bit ring attached to the first end of the bit, and a second bit ring attached to the second end of the bit such that the first end of the first strap is attached to the first bit ring using a first clip; the first end of the second strap is attached to the first bit ring using a second clip; and the second end of the second strap is attached to the second bit ring using a third clip, such that second strap passes through the second bit ring and the pulley ring.

2. The bridle of claim 1 wherein the third clip is detachable such that the second end of the second strap can be detached from the second bit ring.

3. The bridle of claim 1 wherein the third clip is detachable such that the second end of the second strap can be detached from the second bit ring to lead the animal from the second end of the second strap.

4. The bridle of claim 3 wherein the second end of the second strap further includes a handle for leading the animal from the second end of the second strap.

5. An adjustable bridle for mounting on the head of an animal, comprising:

a mouthpiece including an elongate bit having a first end and a second end;

a first strap, a second strap and a pulley ring;

wherein the first strap has a first end and a second end, such that the second end of the first strap is attached to the pulley ring and the first end of the first strap includes a first attachment device that is configured to be attached to the first end of the bit;

the second strap has a first end and a second end, corresponding to the first end and the second end of the bit, respectively, such that: (i) the first end of the second strap includes a second attachment device that is configured to be attached to the first end of the bit, and (ii) the second end of the second strap includes a third attachment device that is configured to be attached to the second end of the bit, such that the second strap passes through the pulley ring;

the mouthpiece further includes a first bit ring attached to the first end of the bit, and a second bit ring attached to the second end of the bit;

the first attachment device at the first end of the first strap is configured to be attached to the first bit ring;

the second attachment device at the first end of the second strap is configured to be attached to the first bit ring;

the third attachment device at the second end of the second strap is configured to be attached to the second bit ring, such that the second strap passes through the second bit ring and the pulley ring; and the third attachment is detachable such that the second end of the second strap can be detached from the second bit ring.

6. The bridle of claim 5 wherein the third attachment device is detachable such that the second end of the second strap can be detached from the second bit ring to lead the animal from the second end of the second strap.

7. The bridle of claim 6 wherein the second end of the second strap further includes a handle for leading the animal from the second end of the second strap.

8. An adjustable bridle for mounting on the head of an animal, comprising:

a mouthpiece including an elongate bit having a first end and a second end;

a short rope, a long rope and a pulley ring, wherein the short rope is shorter than the long rope;

wherein the short rope has a first end and a second end, such that the first end of the short rope is attached to the first end of the bit, and the second end of the short rope is attached to the pulley ring;

wherein the long rope has a first end and a second end, corresponding to the first end and the second end of the bit, respectively, such that: (i) the first end of the long rope is attached to the first end of the bit along with said first end of the short rope, and (ii) the second end of the long rope is attached to a bit ring at the second end of the bit, such that the long rope passes through the bit ring and then the pulley ring;

wherein the bridle is adjustable for a smaller animal head by pulling the long rope through the pulley ring to shorten a portion of the long rope running between the pulley ring and the second end of the bit;

wherein the bridle is adjustable for a larger animal head by slackening the long rope through the pulley ring to lengthen a portion of the long rope running between the pulley ring and the second end of the bit; and wherein the long rope forms reins for riding the animal, and detaching the second end of the long rope from the bit ring at the second end of the bit allows for leading the animal from the second end of the long rope.

* * * * *